US005556312A

United States Patent [19]

Ogino

[11] Patent Number: 5,556,312

[45] Date of Patent: Sep. 17, 1996

[54] BEARING ARRANGEMENT FOR MARINE TRANSMISSION

[75] Inventor: Hiroshi Ogino, Hamamatsu, Japan

[73] Assignee: Sanshin Kogyo Kabushiki Kaisha, Shizuoka-ken, Japan

[21] Appl. No.: 455,048

[22] Filed: May 31, 1995

Related U.S. Application Data

[63] Continuation-in-part of Ser. No. 346,383, Nov. 29, 1994, Pat. No. 5,514,014.

[30] Foreign Application Priority Data

Nov. 29, 1993 [JP] Japan ..... 5-298250
May 31, 1994 [JP] Japan ..... 6-118799

[51] Int. Cl.[6] ..... B63H 21/28

[52] U.S. Cl. ..... 440/75; 440/80; 416/129; 192/48.7

[58] Field of Search ..... 440/75, 79, 80, 440/81, 83; 416/128, 129 R, 129 A; 192/48.7, 114

[56] References Cited

U.S. PATENT DOCUMENTS 537,612 4/1895 Leathers .
599,125 2/1898 Fefel .
624,674 5/1899 Painton .
938,911 11/1909 Taylor .
1,807,254 5/1931 Piano .
1,813,552 7/1931 Stechauner .
1,853,694 4/1932 Melcher .
2,058,361 10/1936 Sherwood .
2,064,195 12/1936 De Michelis .
2,347,906 5/1944 Hatcher .
2,372,247 3/1945 Billing .
2,672,115 3/1954 Conover .
2,987,031 6/1961 Odden .
2,989,022 6/1961 Lundquist .
3,478,620 11/1969 Shimanckas .
3,769,930 11/1973 Pinkerton .
4,529,387 7/1985 Brandt ..... 440/66
4,540,369 9/1985 Caires ..... 440/81
4,619,584 10/1986 Brandt ..... 416/129
4,642,059 2/1987 Nohara ..... 440/75
4,741,670 5/1988 Brandt ..... 416/129
4,767,269 8/1988 Brandt ..... 416/124
4,790,782 12/1988 McCormick ..... 440/75
4,792,314 12/1988 McCormick ..... 440/81
4,793,773 12/1988 Kinouchi et al. ..... 416/129
4,795,382 1/1989 McCormick ..... 440/81
4,828,518 5/1989 Kouda et al. ..... 440/75
4,832,570 5/1989 Solia ..... 416/93
4,832,636 5/1989 McCormick ..... 440/80
4,840,136 6/1989 Brandt ..... 440/78
4,887,982 12/1989 Newman et al. ..... 440/81
4,887,983 12/1989 Bankstahl et al. ..... 440/75
4,897,058 1/1990 McCormick ..... 440/80
4,932,907 6/1990 Newman et al. ..... 440/75
4,963,108 10/1990 Koda et al. ..... 440/81
4,993,848 2/1991 John et al. ..... 440/81
5,009,621 4/1991 Bankstahl et al. ..... 440/75
5,017,168 5/1991 Ackley ..... 440/82
5,030,149 7/1991 Fujita ..... 440/75
5,186,609 2/1993 Inoue et al. ..... 416/129
5,230,644 7/1993 Meisenburg et al. ..... 440/80
5,232,386 8/1993 Gifford ..... 440/80
5,249,995 10/1993 Meisenburg et al. ..... 440/81
5,342,228 8/1994 Magee et al. ..... 440/76
5,344,349 9/1994 Meiscnburg et al. ..... 440/80
5,352,141 10/1994 Shields et al. ..... 440/80
5,366,398 11/1994 Meisenburg et al. ..... 440/81

*Primary Examiner*—Jesus D. Sotelo
*Attorney, Agent, or Firm*—Knobbe, Martens, Olson & Bear

[57] ABSTRACT

An improved transmission bearing assembly for a counter-rotating propeller system of a marine outboard drive directly journals the driven gears of the transmission on the propulsion shafts of the outboard drive. The hub of one driven gear is journaled between a portion of an inner propulsion shaft and a hollow end of the outer propulsion shaft. The bearing assembly also supports the hollow end of the outer propulsion shaft at a front end of a bearing carrier and supports a rearward section of the outer shaft at a rear end of the bearing carrier. The span between the bearing assemblies journaling the outer propulsion shaft within the bearing carrier is increased by positioning the bearing assemblies at the ends of the bearing carrier. The positions of the bearing assemblies at the ends of the bearing carrier thus improves the stability of the outer propulsion shaft.

30 Claims, 6 Drawing Sheets

BEARING ARRANGEMENT FOR MARINE TRANSMISSION

RELATED CASES

The present application is a continuation-in-part of U.S. application Ser. No. 08/346,383, filed on Nov. 29, 1994 now U.S. Pat. No. 5,514,014. In addition, the present application and the parent application each claim foreign priority from Japanese Patent Application Serial Nos. Hei 6-118799 and Hei 5-298250, respectively.

BACKGROUND OF INVENTION

1. Field of the Invention

The present invention relates in general to a marine propulsion system, and more particularly to a transmission of an outboard drive.

2. Description of Related Art

Several outboard drives of a marine watercrafts now employ counter-rotating propeller systems operated by forward/neutral/reverse transmissions. Such propulsion systems are common in both outboard motors and in outboard drive units of inboard/outboard motors.

Prior transmissions used with counter-rotating propeller systems typically include a drive pinion and a pair of oppositely rotating driven bevel gears. Each driven gear includes a hub that is journaled within a lower unit of the outboard drive by a bearing assembly.

A front dog clutch of a dual clutch assembly of the transmission is interposed between the pair of oppositely rotating gears. The front dog clutch is moved between positions in which the clutch engages the gears. In this manner, the front dog clutch selectively couples an inner propeller shaft to one of the driven gears to rotate a first propeller in either a forward or a reverse direction.

The transmission also includes a second dog clutch that is positioned on the rear side of the rear driven gear hub. The rear clutch selectively engages corresponding teeth formed on the rear side of the hub of the rear gear. The rear clutch also is coupled to a hollow outer propulsion shaft which is drives when engaged with the rear gear.

A pair of spaced bearing assemblies commonly journal the hollow outer propeller shaft within the lower unit. The bearings assemblies lie within a bearing carrier which extends to the rear side of the transmission. A first bearing assembly of the pair typically supports the front end of the outer propeller shaft at a position directly behind the rear driven gear. The second bearing assembly supports the outer propeller shaft at the rear end of the bearing carrier.

In many lower unit arrangements, the inner shaft extends through the hollow outer propeller shaft and passes through both the front and rear driven gears. An actuator mechanism or the housing of the lower unit commonly support the front end of the inner propeller shaft and a needle bearing assembly supports the inner shaft toward the rear end of the outer propeller shaft. The inner shaft generally is not support at any other points along its length.

SUMMARY OF INVENTION

The present invention includes the recognition that the driven gears in prior transmissions slightly wobble when rotating about the axis of the shafts. This unbalance rotation tends to increase wear of the gears and to decrease the efficiency of energy transfer through the transmission.

It also is realized that the stability of the outer shaft can be improved by increasing the spacing between the support bearings. Prior outboard drive designs tend to support the outer shaft at two closely spaced points along the outer shaft. The first and second bearing assemblies support only a fraction of the outer shaft length because of the minimum space in the lower unit behind the hub of the rear transmission gear. By overlapping the gear hub and the front end of the outer shaft along the axis of the shaft, the span between the front and rear bearing assemblies can be increased and the stability of the outer shaft thus improved.

One aspect of the present invention thus involves a marine outboard drive comprising a transmission. The transmission includes at least a first driven gear having a bearing hub and a corresponding first clutch which is coupled to a first propulsion shaft of the outboard drive. The clutch selectively couples the first driven gear to the first propulsion shaft. The first propulsion shaft extends along a drive axis with the bearing hub rotatably supported about the drive axis. The first propulsion shaft has a hollow rim which surrounds at least a portion of the bearing hub of the first gear.

In accordance with another aspect of the present invention, a marine outboard drive comprises a first propulsion shaft which extends along a drive axis and a transmission which selectively engages the first propulsion shaft. A first bearing assembly journals an end of the first propulsion shaft within a housing of the outboard drive. The transmission comprises a first driven gear having a hub. The hub is positioned to rotate generally about the drive axis and to generally coincide with the axial position of the bearing assembly along the drive axis.

An additional aspect of the present invention involves a marine outboard drive comprising a transmission. The transmission includes first and second counter-rotating gears. A first clutch is connected to a first propulsion shaft and is adapted to selectively engage either the first or second gear. A second clutch is coupled to the first clutch and is connected to a second propulsion. First and second bearing assemblies journal the first and second gears on the first propulsion shaft.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
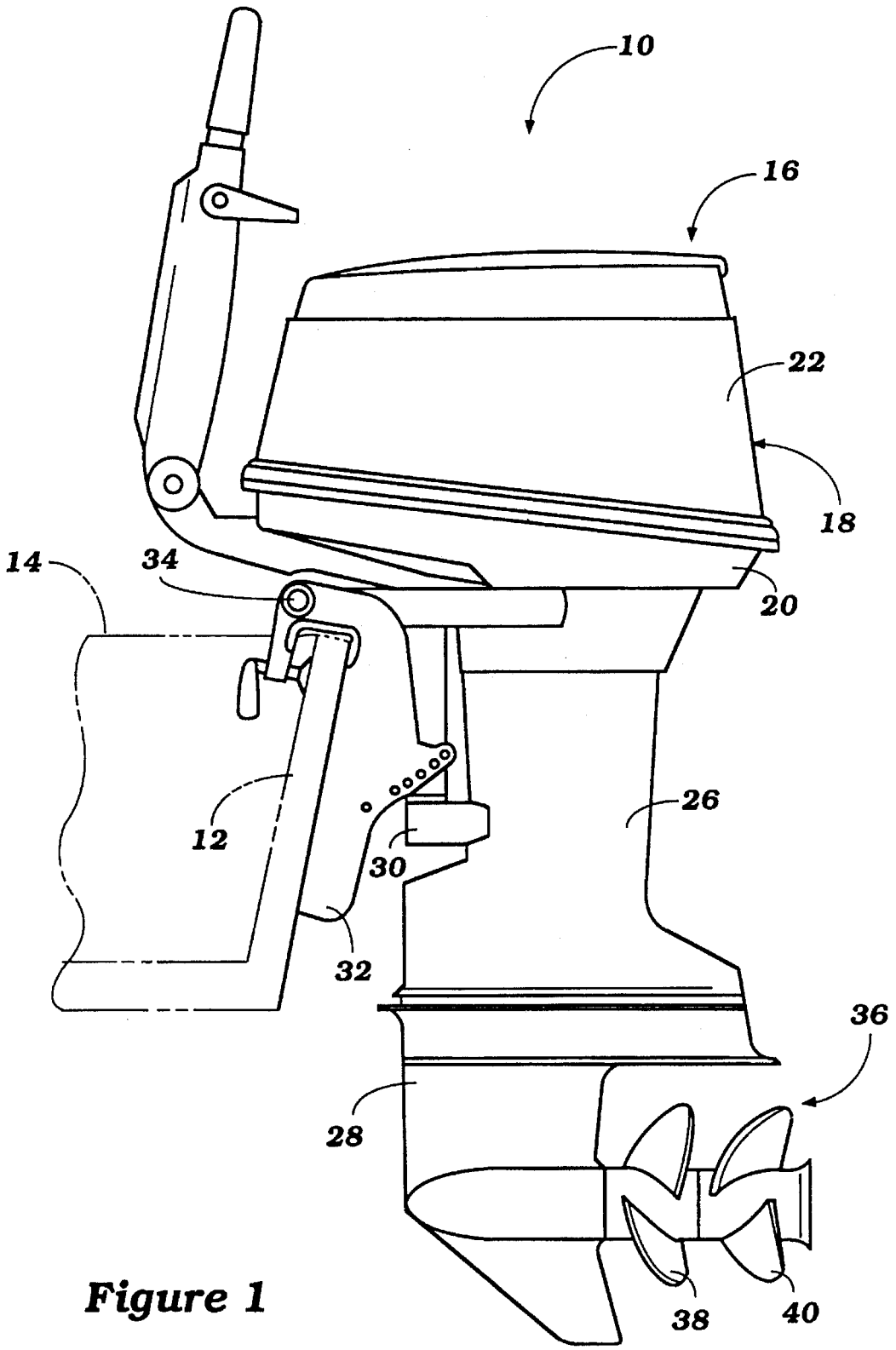
FIG. 1 is a side elevational view of an outboard drive of the type which can embody a transmission in accordance with the present invention.

FIG. 1 illustrates a marine outboard drive 10 of the type which can embody the present transmission. In the illustrated embodiment, the outboard drive 10 is depicted as an outboard motor for mounting on a transom 12 of a watercraft 14. It is contemplated, however, that those skilled in the art will readily appreciate that the present invention can be applied to a stern drive unit of an inboard-outboard motor as well.

In the illustrated embodiment, the outboard drive 10 has a power head 16 which includes an engine. A conventional protective cowling 18 surrounds the engine. The cowling 18 desirably includes a lower tray 20 and a top cowling member 22. These components 20, 22 of the protective cowling 18 together define an engine compartment which houses the engine.

The engine is mounted conventionally with its output shaft (i.e., crankshaft) rotating about a generally vertical axis. The crankshaft (not shown) drives a drive shaft 24 (FIG. 2), as known in the art. The drive shaft 24 depends from the power head 16 of the outboard drive 10.

A drive shaft housing 26 extends downward from the lower tray 20 and terminates in a lower unit 28. The drive shaft 24 extends through and is journaled within the drive shaft housing 26, as known in the art.

A steering bracket 30 is attached to the drive shaft housing 26 in a known matter. The steering bracket 30 also is pivotably connected to a clamping bracket 32 by a pin 34. The clamping bracket 32, in turn, is configured to attach to the transom 12 of the watercraft 14. This conventional coupling permits the outboard drive 10 to be pivoted relative to the steering bracket 30 for steering purposes, as well as to be pivoted relative to the pin 34 to permit adjustment to the trim position of the outboard drive 10 and for tilt up of the outboard drive 10. Although not illustrated, it is understood that a conventional hydraulic tilt and trim cylinder assembly, as well as a conventional hydraulic steering cylinder assembly can be used as well with the present outboard drive 10.

The engine of outboard motor drives a propulsion device 36, such as, for example, a propeller, a hydrodynamic jet, or the like. In the illustrated embodiment of FIG. 1, the propulsion device 36 is a counter-rotating propeller device that includes a front propeller 38 designed to spin in one direction and to assert a forward thrust, and a rear propeller 40 designed to spin in an opposite direction and to assert a forward thrust.

Figure 2:
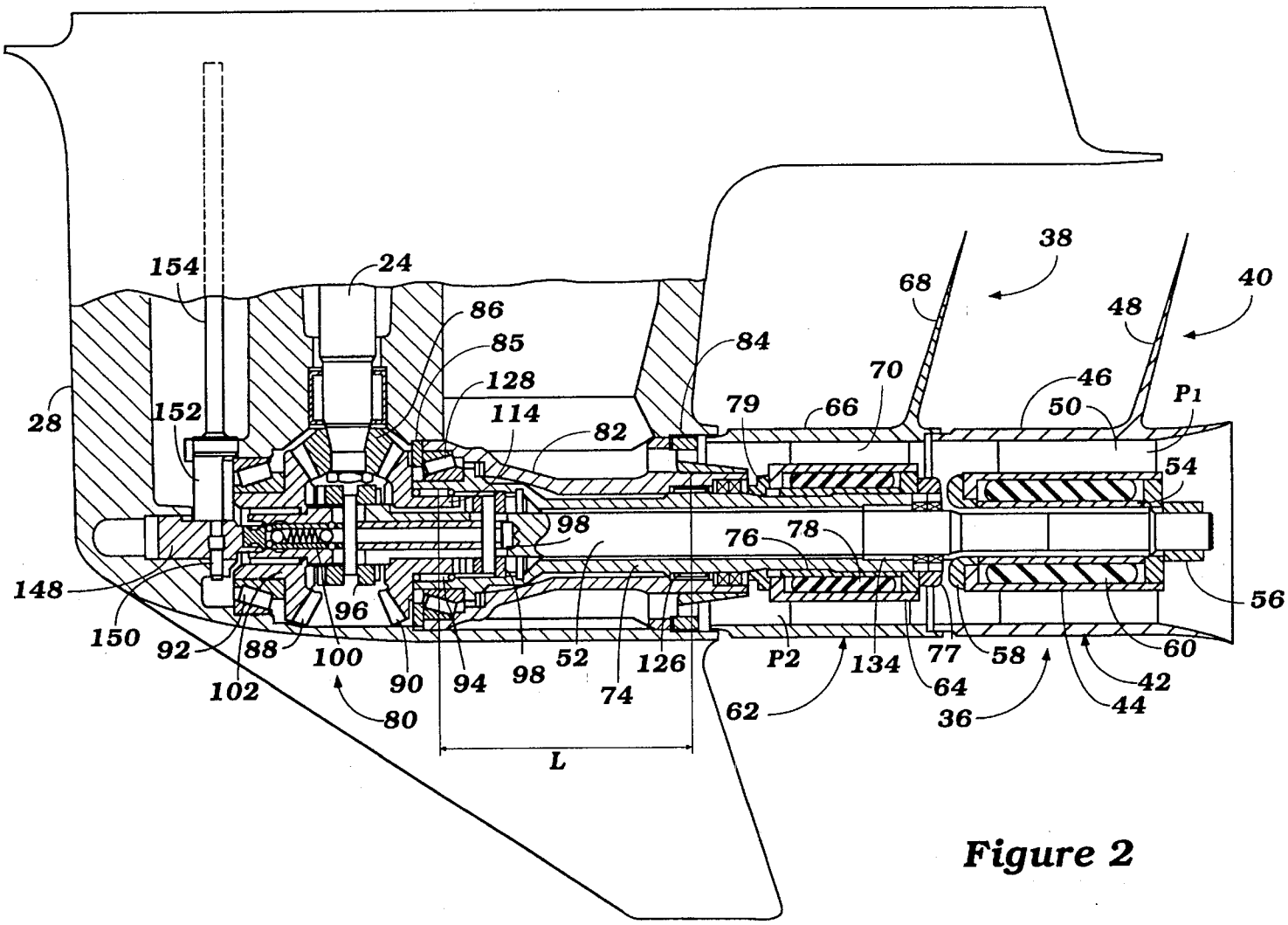
FIG. 2 is a sectional side elevational view of a lower unit of the outboard drive of FIG. 1 illustrating a preferred embodiment of the present transmission.

FIG. 2 illustrates the components of the front and rear propellers 38, 40. The rear propeller 40 includes a boss 42 which is formed in part by an inner sleeve 44 and an outer sleeve 46 to which the propeller blades 48 are integrally formed. A plurality of radial ribs 50 extend between the inner sleeve 44 and the outer sleeve 46 to support the outer sleeve 46 about the inner sleeve 44 and to form a passage $P_1$ through the propeller boss 42. Engine exhaust is discharged through the passage $P_1$, as known in the art.

An inner propulsion shaft 52 drives the rear propeller boss 42. For this purpose, the rear end of the inner shaft 52 carries an engagement sleeve 54 having a spline connection with the rear end of the inner shaft 52. The sleeve 54 is fixed to the rear end of the inner shaft 52 between a nut 56 threaded on the rear end of the shaft 52 and a conventional thrust washer 58 positioned between the front and rear propellers 38, 40.

An elastic bushing 60 is interposed between the engagement sleeve 54 and the rear propeller boss 42 and is compressed therebetween. The bushing 60 is secured to the engagement sleeve 54 by a heat process known in the art. The frictional engagement between the boss 42, the elastic bushing 60, and the engagement sleeve 54 is sufficient to transmit rotational forces from the sleeve 54, driven by the inner propulsion shaft 52, to the rear propeller blades 48.

The front propeller 38 likewise includes a front propeller boss 62. The front propeller boss 62 has an inner sleeve 64 and an outer sleeve 66. Propeller blades 68 of the front propeller 38 are integrally formed on the exterior of the outer sleeve 64. Ribs 70 interconnect the inner sleeve 66 and the outer sleeve 64 and form an axially extending passage $P_2$ between the sleeves 64, 66. The passage $P_2$ communicates with a conventional exhaust discharge passage 72 in the lower unit and with the exhaust passage $P_1$ of the rear propeller boss 42.

An outer shaft 74 carries the front propeller 38. As best seen in FIG. 2, the outer shaft 74 carries a front engagement sleeve 76 at its rear end in driving engagement through a spline connection. The front engagement sleeve 76 is secured onto the outer shaft between a nut 77 threaded onto the rear end of the outer shaft 74 and a conventional thrust washer 79 which engages the outer shaft 74 in a known manner.

A front annular elastic bushing 78 surrounds the front engagement sleeve 76. The bushing 78 is secured to the sleeve 76 by heat process known in the art.

The front propeller boss 62 surrounds the elastic bushing 78, which is held under pressure between the boss 62 and the sleeve 76 in frictional engagement. The frictional engagement between the propeller boss 62 and the bushing 78 is sufficient to transmit a rotational force from the sleeve 76 to the propeller blades 68 of the front propeller boss 62.

The inner and outer propulsion shafts 52, 74 extend from the propellers 38, 40 into the lower unit 28, through a bearing carrier 82, and to a transmission 80, which selectively couples the propulsion shafts 52, 74 to the drive shaft 24. A retainer ring 84, which is attached to the lower unit 28, secures the bearing carrier 82 to the lower unit 28. An enlarged front end of the bearing carrier 82 is screwed into the lower unit housing 28 until it contacts an annular thrust plate 85 positioned proximate to the transmission 80.

FIG. 2 also illustrates a preferred embodiment of the present transmission 80. The transmission 80 advantageously is a forward/neutral/reverse-type transmission which simultaneously drives the inner and outer propulsion shafts 52, 74 in a first direction and in a second counter direction, respectively. Because the pitch of the propeller blades 48, 68 are of opposite hand, the oppositely spinning blades 48, 68 both produce a forward driving thrust when driven under a forward drive condition. Under a reverse drive condition, the transmission desirably drives only one of the propellers 38, 40. In the illustrated embodiment, the transmission drives only the inner propulsion shaft 52 and thus the rear propeller 40 under a reverse drive condition; however, the transmission 80 can be configured alternatively to drive front propeller 38 or both propellers 38, 40 as well when driven under a reverse drive condition.

As seen in FIG. 2, the drive shaft 24 carries a drive gear 86 at its lower end, which is disposed within the lower unit 28 and which forms a portion of the transmission 80. The drive gear 86 preferably is a bevel type gear.

The transmission 80 also includes a pair of counter-rotating driven gears 88, 90 that are in mesh engagement with the drive gear 86. The pair of driven gears 88, 90 preferably are positioned on diametrically opposite sides of the drive gear 86 and are suitably journaled within the lower unit 28 by front and rear bearing assemblies 92, 94, respectively, as described below.

FIG. 2 also illustrates a front clutch 96 and a rear clutch 98 of the present transmission 80. In the illustrated embodiment, a plunger 100 interconnects the clutches 96, 98 for simultaneous operation. As discussed in detail below, the front clutch 96 selectively couples the inner propulsion shaft 52 to either to the front gear 88 or to the rear gear 90. The rear clutch 98 selectively couples the outer propulsion shaft 74 to the rear gear 90. In the illustrated embodiment, the clutches 96, 98 are positive clutches, such as, for example, dog clutches; however, it is understood that the present transmission could be designed with friction-type clutches. The individual components of the present transmission 80 will now be described in detail.

Figure 3:
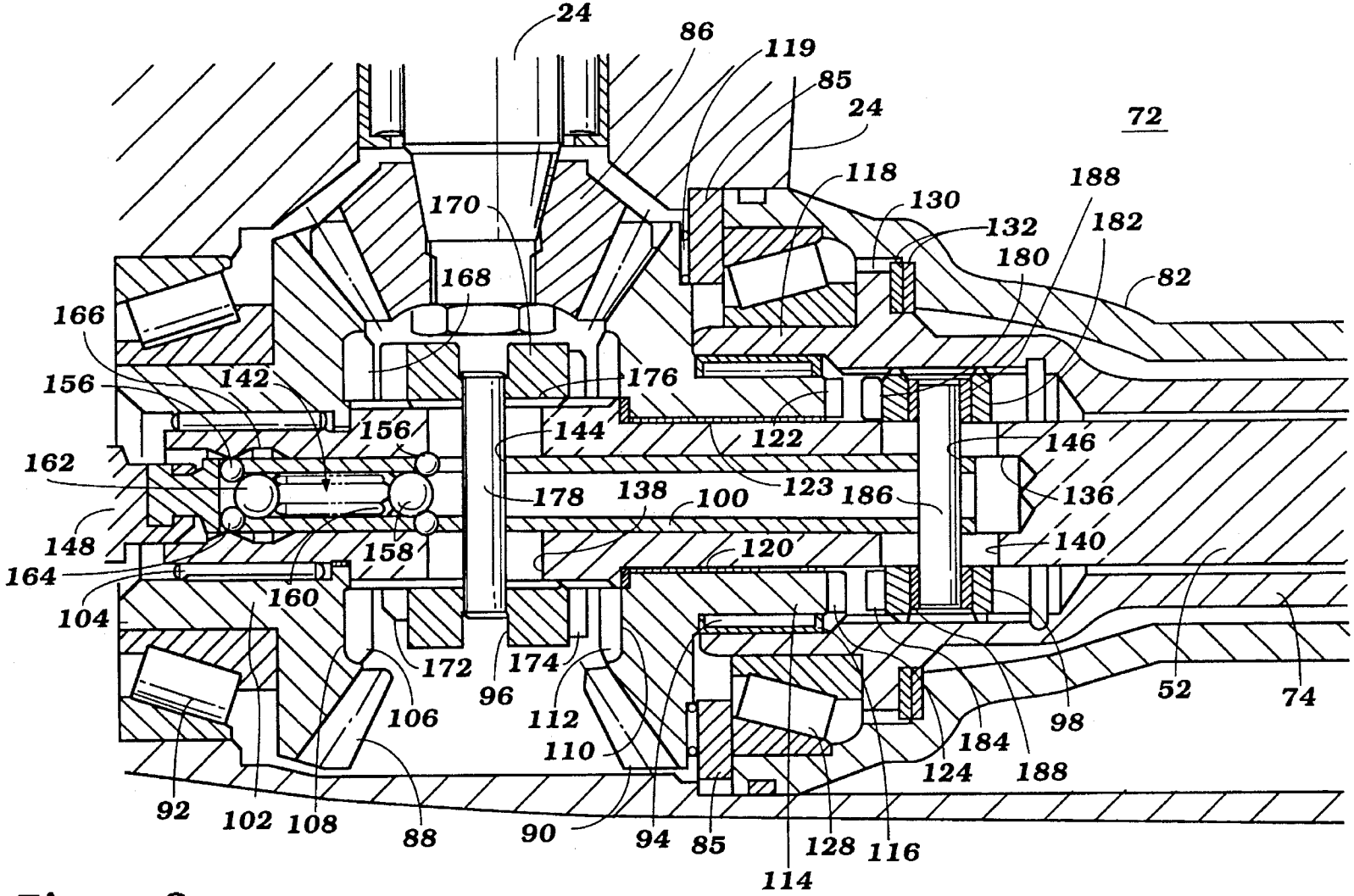
FIG. 3 is an enlarged sectional side elevational view of the transmission of FIG. 2.

With reference to FIG. 3, each driven gear 88, 90 of the transmission 80 is positioned at about a 90° shaft angle with the drive gear 86. That is, the propulsion shafts 52, 74 and the drive shaft 24 desirably intersect at about a 90° shaft angle; however, it is contemplated that the drive shaft 24 and the propulsion shafts 52, 74 can intersect at almost any angle.

In the illustrated embodiment, the pair of driven gears are a front bevel gear 88 and an opposing rear bevel gear 90. The front gear 88 includes a bearing hub 102 which is journaled within the lower unit by the front thrust bearing 92. The front thrust bearing 92 rotatably supports the front gear 88 in mesh engagement with the drive gear 86. The front thrust bearing 92 also takes the thrust loading on the driven gear 88 produced by the engagement with the drive pinion 86 and transferred from the inner propulsion shaft 52, as discussed below.

The hub 102 has a central bore through which the inner propulsion shaft 52 passes when assembled. A plurality of needle bearings 104 journal the inner propulsion shaft 52 within the central bore of the front gear hub 102. As seen in FIG. 3, the inner propulsion shaft includes a step diameter section at its front end to receive the needle bearings 104 in this location.

The front gear 88 also includes a series of teeth 106 formed on an annular rear facing engagement surface 108. The teeth 106 positively engage the front clutch 96 of the transmission 80, as discussed below.

As seen in FIG. 3, the rear gear 90 also includes an annular front engagement surface 110 which carries a series of clutching teeth 112. The teeth 112 are configured to positively engage the front clutch 96 of the transmission 80, as discussed below.

The rear gear 90 includes a bearing hub 114 which is suitably journaled within the bearing casing 82 of the lower unit 28 by the needle bearing assembly 94. The rear bearing assembly 94 rotatably supports the rear gear 90 in mesh engagement with the drive gear 86. The needle bearing assembly 94 includes an outer cage 116 that is received and retained within an enlarged-diameter, front-end outer rim 118 of the hollow outer propulsion shaft 74. A needle-like thrust bearing assembly 119 is interposed between the rear gear 90 and the thrust plate 85 to take the thrust loading on the rear gear 90.

The bearing hub 114 of the rear gear 90 advantageously has a hollow shape with an inner bore 120 that extends entirely through the gear 90 from the front engagement surface 116 to a rear engagement surface 122 of the hub 114. The inner bore 120 has a sufficiently sized diameter to receive the inner propulsion shaft 52 when assembled. A bushing sleeve 123 directly journals the rear gear 90 on the inner propulsion shaft 52 to minimize any wobbling in the spinning gear 90 about axis of the shaft 52.

The rear engagement surface 122 of the rear gear hub 114 desirably lies generally parallel to the front engagement surface 110 and generally perpendicular to the axis of the inner bore 120. The rear engagement surface 122 carries a series of clutching teeth 124 which engage a portion of the rear clutch 98 as discussed below.

As seen in FIGS. 2 and 3, the inner propulsion shaft 52 and the hollow outer propulsion shaft 74 extend from the transmission 80 through the bearing carrier 82. The bearing casing 82 rotatably supports the outer propulsion shaft 74, with the inner propulsion shaft 52 journaled within the outer propulsion shaft 74. A rear needle bearing assembly 126 supports the outer propulsion shaft 74 at a rear end of the bearing carrier 82. And, as best seen in FIG. 2, a front thrust bearing assembly 128 journals the front rim 118 of the outer propulsion shaft 74 within the bearing carrier 82.

As best seen in FIG. 3, the bearings which support the inner shaft 52, the rear gear 90 and the outer shaft 74 at the front end of the bearing carrier 82 are concentrically positioned at about the same point along the axis of the propulsion shafts 52, 74. The rear gear hub 114 surrounds the inner propulsion shaft 52, the rim 118 of the outer shaft 74 surrounds the rear gear hub 114, and the enlarged front portion of the bearing carrier 82 surrounds the outer shaft rim 118. Also within the enlarged front portion of the bearing carrier 82, the thrust bearing assembly 128 extends about the rear gear hub 114 to journal the outer shaft rim 118. As understood from FIG. 3, the rear gear hub 114 is supported between the outer shaft rim 118 and the inner propulsion shaft 52 by the needle bearing assembly 94 and the inner bushing 123, respectively.

The overlapping arrangement between the outer shaft rim 118 and the rear gear hub 114 along the axis of the propulsion shafts allows the front thrust bearing assembly 128 to journal the outer shaft 74 at a position within the lower unit 28 spaced further forward of the rear end of the bearing carrier 82 than prior transmission designs. This bearing configuration thus increases the span L between the front thrust bearing assembly 128 and the rear bearing assembly 126 to widen the supported length and improve the stability of the outer shaft 74 over prior designs.

With reference to FIG. 3, the outer propulsion shaft 74 also includes an integrally formed thrust flange 130 which circumscribes the enlarged front rim 118 of the shaft 74. The thrust flange 130 has a forward facing thrust surface that engages the inner race of the thrust bearing assembly 128 so as to transfer the forward driving thrust from the propeller 38 through the thrust bearing 128 and thrust plate 85 to the lower unit housing 28. Rearward driving thrusts are transmitted to the bearing carrier 82 and lower unit housing 28 from a rear facing thrust shoulder of the thrust flange 130. A pair of conventional anti-friction washers 132 are interposed between the rear face of the thrust flange 130 and a shoulder of the bearing carrier 82.

As seen in FIG. 3, the front rim 118 of the hollow outer propulsion shaft 74 extends in front of the thrust flange 130. The front rim 118 has an outer diameter which is sized to fit within the enlarged front end of the bearing carrier 82 while receiving the rear gear hub and supporting needle bearings. The front end of the shaft also has an inner diameter which is sized to receive the rear clutch 98, as discussed below.

The inner propulsion shaft 52, as noted above, extends through front gear hub 102 where the needle bearing rows 104 journal the front end of the inner propulsion shaft 52 within the front gear 88. The inner propulsion shaft 52 also extends through the rear gear hub 114 and through the hollow outer propulsion shaft 74. As seen in FIG. 2, a needle bearing assembly 134 journals and supports the inner shaft 52 at the rear end of the outer propulsion shaft 74. The inner shaft 52 projects beyond the rear end of the outer shaft 74 to support the rear propeller 40.

With reference to FIG. 3, the front end of the inner propulsion shaft 52 includes a longitudinal bore 136. The longitudinal bore 136 stems from the front end of the inner shaft 52 to a point which generally coincides with the axial position of transition in inner diameters of the hollow outer shaft 74.

A front aperture 138 extends through the inner shaft 52, transverse to the axis of the longitudinal bore 136, at a position that is generally symmetrically between the driven gears 88, 90. The inner shaft 52 also includes a rear aperture 140 that extends transverse to the axis of the longitudinal bore 148 at a position within the front end of the outer propulsion shaft 74, on the rear side of the rear end 122 of the rear gear hub 114.

The plunger 100 has a generally cylindrical rod shape and slides within the longitudinal bore 136 of the inner shaft 52 to actuate the clutches 96, 98. In the illustrated embodiment, the plunger 100 is hollow and houses a neutral detent mechanism 142. The detent mechanism 142 will be discussed below.

The plunger 100 includes a front hole 144 that is positioned generally transverse to the longitudinal axis of the plunger 100, and a rear hole 146 that is likewise positioned generally transverse to the longitudinal axis of the plunger 100. Each hole 144, 146 desirably is symmetrically located in relation to the corresponding apertures 138, 140 of the inner propulsion shaft 52.

As understood from FIGS. 2 and 3, the forward end of the plunger 100 is captured within a slot formed in an actuating cam follower 148, which is slidably supported in a known manner in the front of the lower unit 28. The conventional interconnection between the actuating cam follower 148 and the front end of the plunger 100 allows the plunger 100 to rotate with the inner shaft 52 relative to the actuating cam follower 148.

With reference to FIG. 2, the actuating cam follower 148 receives a crank portion 150 of an actuator 152. The actuator 152 is journaled for rotation in the lower unit 28 and is coupled to a shift rod 154 which extends upwardly to a transmission actuator mechanism (not shown). Rotation of the shift rod 154 and actuator crank 150 positively reciprocates the cam follower 148 and the plunger 100 so as to shift the clutches 96, 98 between a forward drive position in which the front and rear clutches 96, 98 engage the first and second gears 88, 90, respectively, a position of non-engagement (i.e., the neutral position shown in FIG. 3), and a reverse drive position in which the front clutch 96 engages the rear gear 90.

The transmission 80 also desirably includes the detent mechanism 142. As best understood from FIG. 3, the detent mechanism 142 operates between the plunger 100 and the inner propulsion shaft 52 to retain the clutches 96, 98 in the neutral position and to provide a predetermined force to resist shifting for torsionally loading the shift rod 154 (FIG. 2). The torsional loading of the shift rod 154 promotes snap engagement between the clutches 96, 98 and gears 88, 90 in the forward and reverse drive positions. This mechanism is of the type described in U.S. Pat. No. 4,570,776, issued Feb. 18, 1986, and entitled "Detent Mechanism for Clutches," which is assigned to the Assignee hereof. This patent provides full details of the detent mechanism, and also the clutch actuating mechanism as thus far described, and is hereby incorporated by reference.

The detent mechanism 142 includes a plurality of detent balls 156 retained within transverse holes in the wall of the plunger 100. A larger ball 158, urged by a compression spring 160, engages a first set of the detent balls 156. The opposite end of the spring 160 engages another large ball 162 which cooperates with a second set of the detent balls 156 to urge them into engagement with a neutral locking groove 164 formed in the inner surface of the longitudinal bore 136 in the front end of the inner propulsion shaft 52. The second set of detent balls 156, as understood from FIG. 3, also can be urged into cam grooves 166 to promote snap engagement when establishing either a forward or reverse drive condition. In view of the description of the detent mechanism incorporated by reference, a further description of the detent mechanism 142 is believed unnecessary.

As seen in FIG. 3, the front clutch 96 generally has a spool-like sleeve shape and includes an axial bore which extends between an annular front engagement face 168 and an annular rear engagement face 170. The bore is sized to receive the inner propulsion shaft 52.

The annular engagement faces 168, 170 of the front clutch 96 are substantially coextensive in size with the annular engagement surfaces 108, 110 of the front and rear gears 88, 90, respectively. The annular engagement faces 168, 170 each support a plurality of clutching teeth 172, 174 which correspond in size and number with the teeth 106, 112 formed on the respective engagement surfaces 108, 110 of the front and rear gears 88, 90.

The front clutch 96 has a spline connection (generally referenced as reference numeral 176) to the inner propulsion shaft 52. Internal splines of the front clutch 96 matingly engage external splines on the external surface of the inner drive shaft 52. This spline connection 176 provides a driving connection between the front clutch 96 and the inner propulsion shaft 52, while permitting the front clutch 96 to slide over the inner propulsion shaft 52, as discussed below.

The front clutch 96 also includes a hole that extends through the midsection of the clutch in a direction generally transverse to the longitudinal axis of the clutch 96. The hole is sized to receive a pin 178 which, when passed through the front aperture 138 of the inner propulsion shaft 52 and through front hole 144 of the plunger 100, interconnects the plunger 100 and the front clutch 96 with a portion of the inner shaft 52 interposed therebetween. The pin 178 may be held in place by a press-fit connection between the pin and the front hole of the plunger 100 or by a conventional coil spring (not shown) which is contained within a groove about the middle of the front clutch 96.

As also seen in FIG. 3, the rear clutch 98 has a cylindrical sleeve shape sized to fit within the enlarged front rim 118 of the outer propulsion shaft 74. External splines extend from the cylindrical external surface of the rear clutch 98. The external splines mate with corresponding internal splines on inner surface of the enlarged front rim 118 of the outer propulsion shaft 74 to establish a driving connection between the rear clutch 98 and the outer shaft 74, yet to permit the clutch 98 to slide along the axis of the shaft 74 within the hollow front rim 118 of the outer shaft 74.

The rear clutch 98 also includes an axial bore which extends between an annular front engagement face 180 and a rear end 182. The bore is sized to receive the inner propulsion shaft 52.

The front engagement face 180 of the rear clutch 98 is substantially coextensive in size with the rear annular engagement surface 122 of the rear gear 90. Teeth 184 extend from the front engagement face 180 of the rear clutch 98 and desirably correspond to the teeth 124 of the rear gear 90 in size (e.g., axial length), in number, and in configuration.

The rear clutch 98 also includes a hole that extends through the midsection of the clutch in a direction generally transverse to the longitudinal axis of the clutch 98. The hole is sized to receive a pin 186 which, when passed through the rear aperture 140 of the inner propulsion shaft 52 and through rear hole 146 of the plunger 100, couples together the plunger 100 and the rear clutch 98. The inner wall of the enlarged front rim 118 of the outer shaft 74 captures the pin 186 within the hole of the rear clutch 98. Anti-friction washers 188 separate the ends of the pin 186 from the body of the rear clutch 98 to minimize frictional contact between the pin 186 and the clutch body 98. In this manner, the rear clutch 98 is coupled to the plunger 100 so as to allow the plunger 100 to rotate in one direction and the clutch 98 to rotate in an opposite direction.

As understood from FIG. 3, the operation of the rear clutch 98 occurs within the enlarged diameter hollow front end 118 of the outer shaft 74. That is, the movement of the clutch 98 from a position of non-engagement to a position of engagement occurs within the hollow front rim 118 of the outer shaft 74 while establishing the driving connection between the rear clutch 98 and outer propulsion shaft 74. The hollow front rim 118 of the outer shaft 74 has a sufficient axial length to permit the rear clutch 98 to move from its neutral position in the rearward direction by a sufficient travel to allow the front clutch 96 to engage the rear gear 90 without interference.

The operation of the present transmission 80 will now be described with primary reference to FIG. 3. FIG. 3 illustrates the front and rear clutches 96, 98 in a neutral position, i.e., in a position of non-engagement with the gears 88, 90. The detent mechanism 142 retains the plunger 100 and coupled the clutches 96, 98 in this neutral position.

To establish a forward drive condition, the actuator cam follower 148 moves the plunger 100 forward, which in turn, slides the front and rear clutches 96, 98 forward over the inner propulsion shaft 52. The forward motion of the plunger 100 positively forces the front clutch 96 into engagement with the front gear 88 with the corresponding clutching teeth 106, 172 mating. The forward motion of the plunger 100 also positively forces the rear clutch 98 to engage the real gear 90 with the corresponding clutching teeth 116, 184 mating.

So engaged, the front gear 88 drives the inner propulsion shaft 52 through the spline connection 176 between the clutch 96 and inner propulsion shaft 52. The inner propulsion shaft 52 thus drives the rear propeller 40 (FIG. 2) in a first direction which assert a forward thrust. As understood from FIG. 3, the rear gear 90 similarly drives the outer propulsion shaft 74 through the spline connection between the rear clutch 98 and outer propulsion shaft 74. The outer propulsion shaft drives the front propeller 38 (FIG. 2) in an opposite direction to that of the rear propeller 40 with the front propeller 39 asserting a forward thrust.

With reference back to FIG. 3, to establish a reverse drive condition, the actuator cam follower 148 moves the plunger 100 in the rearward direction, which in turn, slides the front and rear clutches 96, 98 rearward over the inner propulsion shaft 52. The rearward motion of the plunger 100 positively forces the front clutch 96 to engage the rear gear 90 with the corresponding clutching teeth 112, 174 mating. So engaged, the rear gear 90 drives the inner propulsion shaft 52 through the spline connection 174 between the clutch 96 and inner propulsion shaft 52. The inner propulsion shaft 52 thus drives the rear propeller 40 (FIG. 2) in a direction which assert a reverse thrust to propel the watercraft 14 (FIG. 1) in a reverse direction.

Figure 4:
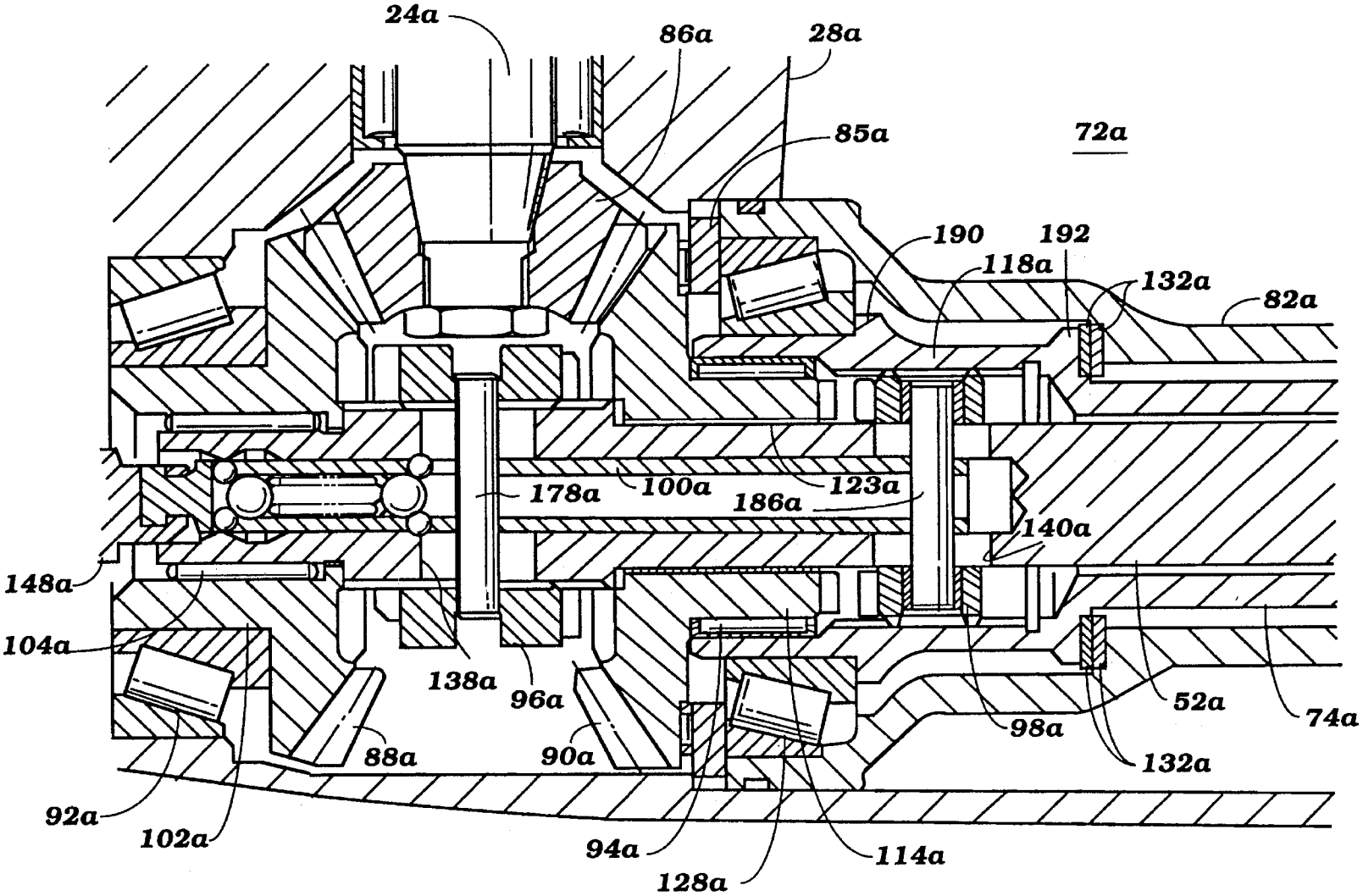
FIG. 4 is a sectional side elevational view of a transmission in accordance with another embodiment of the present invention.

FIG. 4 illustrates another preferred embodiment of the present transmission. Where appropriate, like numbers with an "a" suffix have been used to indicate like parts between the two embodiments for ease of understanding. The present transmission **80*a* is substantially identical to the transmission 80 described above, except for the configuration of the thrust flange of the outer shaft 74*a* and the thrust shoulder formed within the bearing carrier 82*a*. Accordingly, the foregoing discussion should be understood as applying equally to the present transmission 80*a***, unless specified to the contrary.

As seen in FIG. 4, the front rim **118*a* of the outer shaft 74*a* carries a pair of thrust flanges 190, 192. The thrust flanges 190, 192 are spaced apart from each other along the length of the shaft 74*a*. The distance between the thrust flanges 190, 192 desirably equals generally about the length of axial displacement of the rear clutch 98*a*** when moved between positions under the forward and reverse drive conditions.

The front thrust flange 190 circumscribes the front rim **118*a* of the shaft 74*a* and forms a front thrust shoulder. The forward thrust shoulder engages the inner race of the thrust bearing assembly 128*a* so as to transfer the forward driving thrust from the propeller 38*a* (not shown in this embodiment) through the thrust bearing 128*a* and thrust plate 85*a* to the lower unit housing 28*a***.

The rear thrust flange 192 also circumscribes the front rim **118*a* at a step in diameter of the outer shaft 74*a* (i.e., at the rear end of the front rim 118*a*). The rear thrust flange 192 forms a rear thrust shoulder which cooperates with a front facing shoulder formed on the inner wall of the bearing casing 82*a*. Rearward driving thrusts are transferred to the bearing carrier 82*a* and lower unit housing 28*a* from the rear facing thrust shoulder of the rear thrust flange 192. A pair of conventional anti-friction washers 132*a* are interposed between the rear face of the thrust flange 192 and a shoulder of the bearing carrier 82*a* to minimize friction between the shaft 74*a* and the bearing carrier 82*a***.

Figure 5:
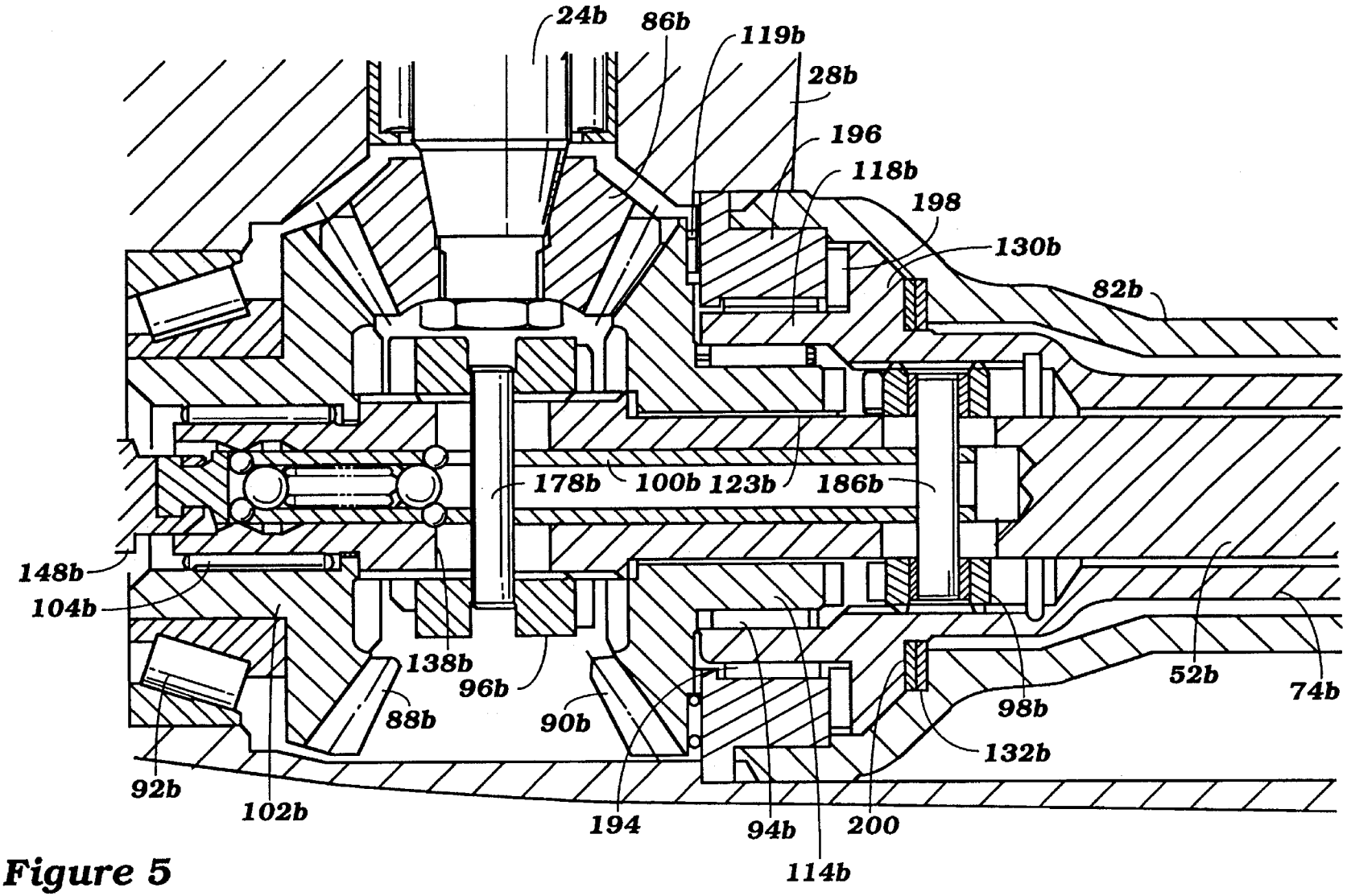
FIG. 5 is a sectional side elevational view of a transmission in accordance with an additional embodiment of the present invention.

FIG. 5 illustrates an additional preferred embodiment of the present transmission with another configuration of the bearing assembly that supports the front rim **118*b* of the outer shaft 74*b*. Where appropriate, like numbers with a "b" suffix have been used to indicate like parts between the embodiments of FIGS. 3 and 5** for ease of understanding.

The present transmission **80*b* is substantially identical to the first transmission 80 described above, except for the configuration of the bearing assembly 128. Accordingly, the foregoing description of the first transmission 80 should be understood as applying equally to the present transmission 80*b***, unless specified to the contrary.

As seen in FIG. 5, a needle bearing assembly 194 journals the front end outer rim **118*b* of the outer shaft 74*b* within the bearing carrier 82*b*. A spacer ring 196 supports the needle bearing assembly 194 within the enlarged froward portion of the bearing carrier 82*b* and functions as an outer race of the bearing assembly 194. Needle-like thrust bearings 119*b* are positioned between the rear gear 90*b* and the spacer ring 196 to take the trust loading on the rear gear 90*b***.

Needle-like thrust bearings 198 are also positioned between the front face of the thrust flange **130*b* and the rear end of the spacer ring 196. Forward driving thrusts from the propeller 38*b* (not shown in this embodiment) are transferred through the thrust bearing 128*b* and spacer ring 196** to the lower unit housing 28*b*. Rearward driving thrusts are transferred to the bearing carrier 82*b* and lower unit housing 28*b* from a rear facing thrust shoulder of the thrust flange 130*b*. A pair of conventional anti-friction washers 132*b* or an anti-friction washer 132*b* in combination with needle-like thrust bearings 200 are interposed between the rear face of the thrust flange 130*b* and a shoulder of the bearing carrier 82*b* so as to transfer rearward driving thrusts to the bearing carrier 82*b* while minimizing frictional contact between the outer shaft 74*b* and the bearing carrier 82*b*.

Figure 6:
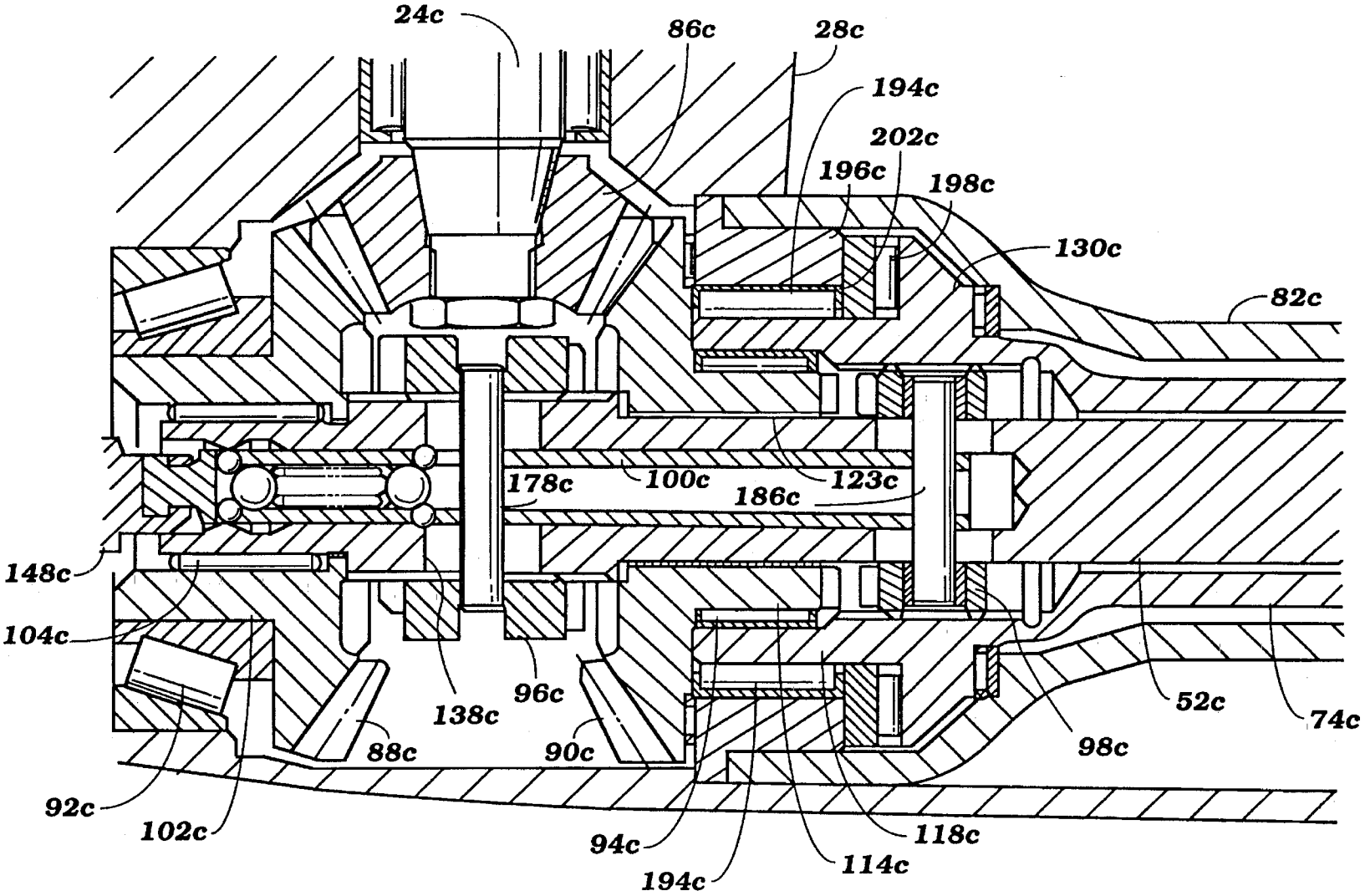
FIG. 6 is a sectional side elevational view of a transmission in accordance with another embodiment of the present invention.

FIG. 6 illustrates another preferred embodiment of the bearing assembly of the present transmission, which is substantially identical to that described in connection with FIG. 5. Where appropriate, like numbers with a "c" suffix have been used to indicate like parts between the two embodiments for ease of understanding.

As seen in FIG. 6, a needle bearing assembly 194*c*, which journals the front end outer rim 118*c* of the outer shaft 74*c* within the bearing carrier 82*c*, includes a cage 202. A spacer ring 196*c* supports the cage 202 and the needle bearing assembly 194*c* within the enlarged froward portion of the bearing carrier 82*c*.

A spacer plate 204 is disposed between the spacer ring 196*c* and the front face of the thrust flange 130*c*. The spacer plate 204 acts on one race of the needle-like thrust bearings 198*c* which journal the front face of the thrust flange 130*c*. Forward driving thrusts from the propeller 38*c* (not shown in this embodiment) are transferred from the thrust flange 130*c*, through the spacer plate 204, thrust bearing 198*c*, and spacer ring 196*c*, and to the lower unit housing 28*c*.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A marine outboard drive comprising a transmission including at least a first driven gear having a bearing hub and a corresponding first clutch which is coupled to a first propulsion shaft of said outboard drive to selectively couple said first driven gear to said first propulsion shaft, said first propulsion shaft extending along a drive axis with said bearing hub rotatably supported about said drive axis, said first propulsion shaft having a hollow rim which surrounds at least a portion of said bearing hub of said first gear.

2. A marine outboard drive as in claim 1, wherein said first clutch is arranged to the side of said hub of said first driven gear along said drive axis.

3. A marine outboard drive as in claim 1, wherein said first propulsion shaft includes a shaft section which extends from said hollow rim, said hollow rim having a larger diameter than said shaft section.

4. A marine outboard drive as in claim 1, wherein said first propulsion shaft is hollow along its entire length.

5. A marine outboard drive as in claim 1 additionally comprising a first bearing assembly which journals said first gear hub within said rim of said first propulsion shaft.

6. A marine outboard drive as in claim 5, wherein said first bearing assembly comprises a plurality of needle bearings.

7. A marine outboard drive as in claim 5 additionally comprising a second bearing assembly which journals said rim of said first propulsion shaft within a housing of said marine outboard drive.

8. A marine outboard drive as in claim 7, wherein said second bearing assembly comprises a thrust bearing assembly.

9. A marine outboard drive as in claim 7, wherein said housing comprises a bearing carrier through which a portion of said first propulsion shaft passes, said second bearing assembly supporting said rim of said first propulsion shaft at one end of said bearing carrier and a third bearing assembly supporting said first propulsion shaft at an opposite end of said bearing carrier.

10. A marine outboard drive as in claim 7, wherein said second bearing assembly is positioned so as to generally coincide with the axial position of said hub of said first driven gear along said drive axis.

11. A marine outboard drive as in claim 10, wherein said first bearing assembly and said second bearing assembly generally coincide in axial position along said drive axis.

12. A marine outboard drive as in claim 7, wherein said first propulsion shaft includes at least a first thrust flange, a first face of which engages said second bearing assembly.

13. A marine outboard drive as in claim 12, wherein a second face of said first thrust flange engages a shoulder of a bearing carrier through which said first propulsion shaft passes.

14. A marine outboard drive as in claim 12, wherein said first propulsion shaft includes a second thrust flange spaced apart from said first thrust flange along said drive axis, said second thrust flange engaging a shoulder of a bearing carrier through which said first propulsion shaft passes.

15. A marine outboard drive as in claim 1 additionally comprising a second propulsion shaft which extends through said hub of said first driven gear of said transmission and through said first propulsion shaft, said first propulsion shaft being hollow, and a bearing assembly journaling said first driven gear on said second propulsion shaft.

16. A marine outboard drive comprising a first propulsion shaft which extends along a drive axis, a first bearing assembly journaling an end of said first propulsion shaft within a housing of said outboard drive, and a transmission which selectively engages said first propulsion shaft, said transmission comprising a first driven gear having a hub, said hub being positioned to rotate generally about said drive axis and to generally coincide with the axial position of said bearing assembly along said drive axis.

17. A marine outboard drive as in claim 16, wherein said first bearing assembly is a thrust bearing assembly.

18. A marine outboard drive as in claim 16, wherein said first propulsion shaft has a hollow end which receives a portion of said hub of said first driven gear.

19. A marine outboard drive as in claim 18 additionally comprising a second bearing assembly interposed between said hub of said first driven gear and said hollow end of said first propulsion shaft so as to journal said shaft end about said gear hub.

20. A marine outboard drive as in claim 16, wherein said housing comprises a bearing carrier with said first bearing assembly positioned at an end of said bearing carrier.

21. A marine outboard drive as in claim 16 additionally comprising a second propulsion shaft which extends through said hub of said first driven gear and through said first propulsion shaft, and a bearing surrounding said second propulsion shaft so as to journal said gear hub on said second propulsion shaft.

22. A marine outboard drive comprising a transmission including first and second counter-rotating gears, a first clutch connected to a first propulsion shaft and adapted to selectively engage either said first or second gear, a second clutch coupled to said first clutch and connected to a second propulsion shaft, and first and second bearing assemblies which journal said first and second gears on said first propulsion shaft.

23. A marine outboard drive as in claim 22, wherein said first bearing assembly comprises a plurality of needle bearings interposed between a hollow hub of said first gear and said first propulsion shaft.

24. A marine outboard drive as in claim 23, wherein said second bearing assembly comprises a bearing sleeve surrounding said first propulsion shaft and interposed between a hollow hub of said second gear and said first propulsion shaft.

25. A marine outboard drive as in claim 22, wherein said second propulsion shaft is hollow and said first and second propulsion shaft extend along a drive axis in a collinear manner.

26. A marine outboard drive as in claim 25, wherein at least a portion of said hub of said second gear is positioned within a hollow end of said second propulsion shaft.

27. A marine outboard drive as in claim 25 additionally comprising a third bearing assembly which journals said second propulsion shaft about said hub of said second gear.

28. A marine outboard drive as in claim 27, wherein at least a portion of said third bearing assembly overlaps at least a portion of said second bearing assembly along said drive axis.

29. A marine outboard drive as in claim 28 additionally comprising a fourth bearing assembly which journals said second propulsion shaft within a bearing carrier, said fourth bearing assembly being positioned along said drive axis so as to generally coincide with the axial position of said second gear hub.

30. A marine outboard drive as in claim 29, wherein said fourth bearing assembly is positioned at an end of said bearing carrier.

* * * * *